US009216570B2

(12) United States Patent
Matsumoto et al.

(10) Patent No.: US 9,216,570 B2
(45) Date of Patent: Dec. 22, 2015

(54) PROCESS FOR PRODUCING LIQUID EJECTION HEAD

(71) Applicant: CANON KABUSHIKI KAISHA, Tokyo (JP)

(72) Inventors: Keiji Matsumoto, Kawasaki (JP); Kazuhiro Asai, Kawasaki (JP); Kunihito Uohashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 168 days.

(21) Appl. No.: 14/011,940

(22) Filed: Aug. 28, 2013

(65) Prior Publication Data

US 2014/0083974 A1 Mar. 27, 2014

(30) Foreign Application Priority Data

Sep. 21, 2012 (JP) ..... 2012-208131

(51) Int. Cl.
*B41J 2/16* (2006.01)
*B41J 2/005* (2006.01)

(52) U.S. Cl.
CPC ..... *B41J 2/005* (2013.01); *B41J 2/1603* (2013.01); *B41J 2/1628* (2013.01); *B41J 2/1629* (2013.01); *B41J 2/1631* (2013.01); *B41J 2/1632* (2013.01); *B41J 2/1635* (2013.01); *B41J 2/1639* (2013.01); *B41J 2/1642* (2013.01); *B41J 2/1645* (2013.01)

(58) Field of Classification Search
None
See application file for complete search history.

(56) References Cited

U.S. PATENT DOCUMENTS 5,331,344 A 7/1994 Miyagawa et al.
5,502,470 A * 3/1996 Miyashita et al. ..... 347/45
8,128,204 B2 * 3/2012 Ozaki et al. ..... 347/56
2002/0001016 A1 * 1/2002 Aono et al. ..... 347/47
2003/0185996 A1 * 10/2003 Shimomura et al. ..... 427/510
2004/0125169 A1 * 7/2004 Nakagawa et al. ..... 347/45
2004/0223033 A1 * 11/2004 Sasaki et al. ..... 347/45
2005/0088485 A1 * 4/2005 Tamahashi et al. ..... 347/45
2008/0170101 A1 * 7/2008 Kwon et al. ..... 347/45

(Continued)

FOREIGN PATENT DOCUMENTS

JP 2694054 B2 12/1997
JP 2009-255415 A 11/2009

OTHER PUBLICATIONS

Samil Chemicals, "Durasurf Spec Sheet" 2011, retrieved from http://www.samilchemicals.co.kr/goods/view.asp?idx=29&category=8&search_type=0&search_word=&page_size=20&page=1.*
Basu, R. S. et al "Potentials of Hydrofluorocarbon (HFC) Solvents for Precision Cleaning" Precision Cleaning—The Magazine of Critical Cleaning Technology, Oct. 1994, pp. 25-29.*

(Continued)

*Primary Examiner* — Anita Alanko
(74) *Attorney, Agent, or Firm* — Fitzpatrick, Cella, Harper & Scinto

(57) ABSTRACT

A process for producing a liquid ejection head, comprising providing a substrate with an energy-generating element for ejecting liquid and a wiring; forming a flow path wall forming layer containing a negative photosensitive resin on the substrate; exposing a portion to be a flow path wall of the flow path wall forming layer; forming an ejection orifice forming layer containing a negative photosensitive resin on the flow path wall forming layer; applying a material for a water-repellent layer onto the ejection orifice forming layer; drying a solvent contained in the applied material to form the water-repellent layer; exposing another region than a portion to be an ejection orifice of the ejection orifice forming layer and the water-repellent layer; and dissolving and removing the non-exposed portions, wherein the boiling point of the solvent is not more than the drying temperature in the step to form the water-repellent layer.

15 Claims, 2 Drawing Sheets

(56) References Cited

U.S. PATENT DOCUMENTS

| | | | | |
|---|---|---|---|---|
| 2012/0074434 | A1* | 3/2012 | Park et al. | 257/88 |
| 2014/0272111 | A1* | 9/2014 | Bradford et al. | 427/11 |

OTHER PUBLICATIONS

Govaerts, et al "Using Hydrofluoroether Solvents to Replace HCFC-141b" Medical Device Technology, Oct. 2001.*

Asai et al., U.S. Appl. No. 13/956,607, filed Aug. 1, 2013.

* cited by examiner

PROCESS FOR PRODUCING LIQUID EJECTION HEAD

BACKGROUND OF THE INVENTION

1. Field of the Invention

The present invention relates to a process for producing a liquid ejection head to be used for conducting recording with an ink or another liquid.

2. Description of the Related Art

Japanese Patent No. 2694054 discloses a process for producing a liquid ejection head, in which a sensitivity ratio is set for a plurality of photoresists to be used, an ejection orifice forming layer is laminated on an optically defined flow path wall forming layer without destroying a flow path wall, and development is conducted collectively after the ejection orifice forming layer is exposed. In addition, Japanese Patent Application Laid-Open No. 2009-255415 discloses a process for producing a liquid ejection head, in which a water-repellent layer is formed on an opening surface of an ejection orifice by, for example, a spin coating method. In recent years, a liquid ejection head has been required to more improve ejection accuracy and meet high-speed printing. In order to realize these requirements, an ejection orifice forming layer has been required to be thinned.

SUMMARY OF THE INVENTION

According to the present invention, there is provided a process for producing a liquid ejection head, comprising the steps of providing a substrate provided with an energy-generating element for generating energy for ejecting a liquid and a wiring, forming a flow path wall forming layer containing a negative photosensitive resin on the substrate, exposing a portion to be a flow path wall of the flow path wall forming layer, forming an ejection orifice forming layer containing a negative photosensitive resin on the flow path wall forming layer, applying a material for a water-repellent layer on to the ejection orifice forming layer, drying a solvent contained in the applied material for the water-repellent layer to form the water-repellent layer, exposing another region than a portion to be an ejection orifice of the ejection orifice forming layer and the water-repellent layer, and dissolving and removing respective non-exposed portions of the flow path wall forming layer, the ejection orifice forming layer and the water-repellent layer, wherein a boiling point of the solvent contained in the material for the water-repellent layer is not more than a drying temperature in the step to form the water-repellent layer by the drying.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 3:
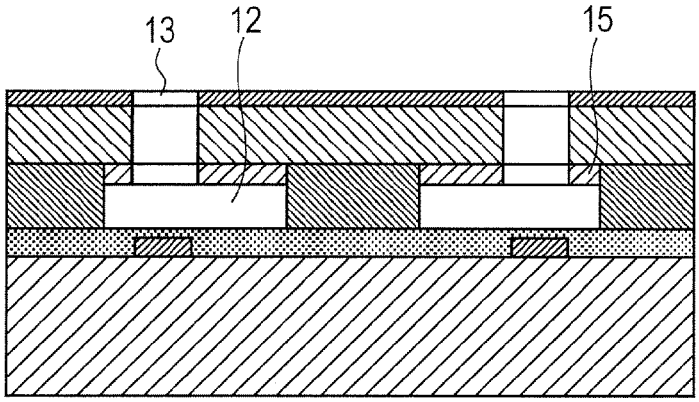
FIG. 3 PRIOR ART
FIG. 3 is a typical sectional view illustrating a process for producing a liquid ejection head according to a prior art.

When a water-repellent layer is formed by applying a material for the water-repellent layer on to an ejection orifice forming layer thinned according to the process described in Japanese Patent No. 2694054, in which the sensitivity ratio is set for the photoresists, there is a problem that the flow path height of a non-exposed portion to be a flow path wall of a flow path wall forming layer becomes low as illustrated in FIG. 3. Specifically, a high-sensitivity initiator of the ejection orifice forming layer is diffused into the non-exposed portion of the flow path wall forming layer by a solvent contained in the material for the water-repellent layer, and so the non-exposed portion of the flow path wall forming layer is also partly exposed upon the exposure of the ejection orifice forming layer to cause a problem that the flow path height becomes lower than a desired flow path height.

In addition, in order to improve the adhesion of the water-repellent layer and form a minute ejection orifice, it is desirable that the water-repellent layer is compatible with the ejection orifice forming layer, and it is also desirable that patterning can be made at the same time as the exposure of the ejection orifice forming layer.

It is an object of the present invention to provide a liquid ejection head having a flow path height with high accuracy for a desired flow path height.

According to the process of the present invention, a solvent whose boiling point is not more than a drying temperature is used, whereby the solvent can be rapidly dried even when the ejection orifice forming layer is thinned, so that a high-sensitivity photopolymerization initiator contained in the ejection orifice forming layer is not diffused into the non-exposed portion of the flow path wall forming layer. Therefore, a flow path can be formed with good accuracy for the desired flow path height. In addition, a solvent that is liable to be mixed with a material for the ejection orifice forming layer is used as the solvent, whereby the ejection orifice forming layer can be compatible with the water-repellent layer to ensure the adhesion between the ejection orifice forming layer and the water-repellent layer.

Figure 2:
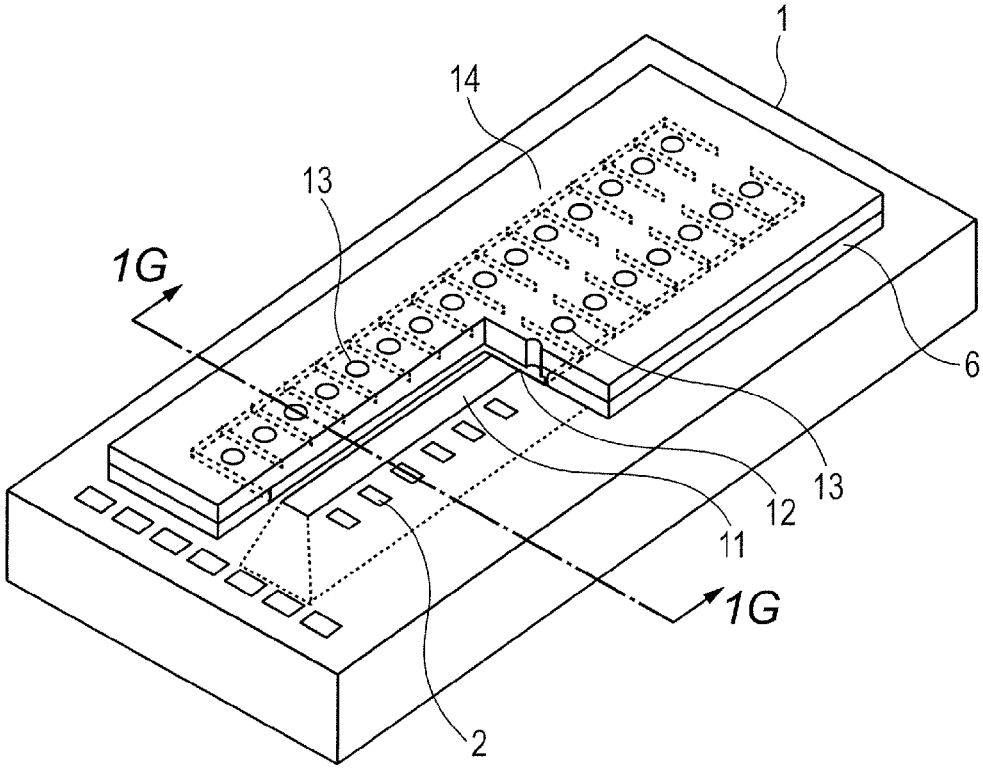
FIG. 2 is a typical perspective view illustrating an exemplary liquid ejection head produced by the process according to the present invention.

FIG. 2 is a typical perspective view illustrating an exemplary liquid ejection head obtained by the process according to the present invention. The liquid ejection head illustrated in FIG. 2 has a substrate 1 on which energy-generating elements 2 have been arranged in two rows at a predefined pitch. A wiring (not illustrated) and a poly(ether amide) layer (not illustrated) as an adhesion improving layer are formed on the substrate 1. In addition, a flow path wall forming layer 6 forming a flow path wall and an ejection orifice forming layer 14 provided with an ejection orifice 13 located above each of the energy-generating elements 2 are formed on the substrate 1. Further, a liquid supply port 11 is formed between the rows of the energy-generating elements 2 in the substrate 1. Furthermore, a flow path 12 communicating with each ejection orifice 13 from the liquid supply port 11 is formed. When a pressure is applied to a liquid such as an ink filled into the flow path 12 from the liquid supply port 11 by the energy-generating elements 2, a liquid is ejected from the ejection orifice 13. This liquid is applied to a recording medium, whereby recording is conducted.

A process for producing a liquid ejection head according to an embodiment of the present invention will be described with reference to FIGS. 1A to 1G. FIGS. 1A to 1G are typical sectional views taken along a cutting-plane line 1G-1G of the liquid ejection head illustrated in FIG. 2 in respective steps. Incidentally, the process according to the present invention is not limited to the embodiment illustrated in FIGS. 1A to 1G.

Figure 1A:
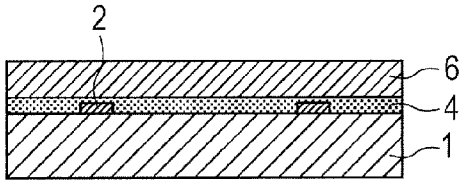
FIGS. 1A, 1B, 1C, 1D, 1E, 1F and 1G are typical sectional views illustrating a process for producing a liquid ejection head according to an embodiment of the present invention.

As illustrated in FIG. 1A, a substrate 1 provided with an energy-generating element 2 for generating energy for ejecting a liquid and a wiring is first provided.

Plural energy-generating elements 2 and wiring (not illustrated) are arranged on the substrate 1 illustrated in FIG. 1A. A silicon substrate may be used as the substrate 1. A heating resistor such as TaSiN and TaSi or a piezoelectric element may be used as the energy-generating element 2. No particular limitation is imposed on the wiring so far as the energy-generating element 2 can be electrically connected to the exterior. In addition, an insulating protective layer 4 is formed on the substrate 1. The insulating protective layer 4 can protect the wiring from an ink or other liquids. For example, SiO, SiN or SiCN may be used as a material for the insulating protective layer 4. These materials may be used either singly or in any combination thereof. The insulating protective layer 4 can be formed by, for example, plasma CVD (chemical vapor deposition). Incidentally, the insulating protective layer 4 may not be formed.

A flow path wall forming layer 6 containing a negative photosensitive resin is then formed on the substrate. Examples of a material for the flow path wall forming layer 6 include bisazide-compound-containing cyclic polyisoprenes and azidopyrene-containing cresol novolak resins, which are photo-crosslinking agents, and diazonium salt-containing epoxy resins and onium-salt-containing epoxy resins, which are photopolymerization initiators. Examples of the negative photosensitive resin include epoxy resins such as bisphenol A type epoxy resins and cresol novolak type epoxy resins. No particular limitation is imposed on a solvent so far as it can dissolve the photo-crosslinking agent or photopolymerization initiator and the photosensitive resin, and examples thereof include propylene glycol monomethyl ether acetate (hereinafter referred to as PGMEA) and γ-butyrolactone. These solvents may be used either singly or in any combination thereof. Incidentally, no particular limitation is imposed on the material for the flow path wall forming layer 6 so far as it is a resist crosslinked by a polymerization initiator. Examples of a method for forming the flow path wall forming layer 6 include a spin coating method and a slit coating method. The thickness of the flow path wall forming layer 6 may be controlled to, for example, 5 μm or more and 20 μm or less. Incidentally, an adhesion improving layer containing, for example, a poly(ether amide) resin may also be formed on the substrate 1 before the flow path wall forming layer 6 is formed.

Figure 1B:
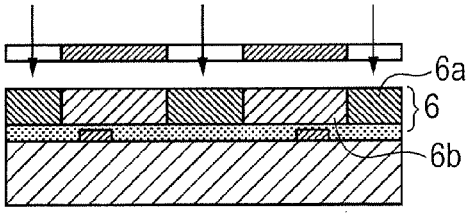

As illustrated in FIG. 1B, a portion to be a flow path wall of the flow path wall forming layer 6 is then exposed. An exposed portion 6*a* to be a flow path wall and a non-exposed portion 6*b* to be a flow path are thereby optically defined. The wavelength upon the exposure may be a wavelength at which the photo-crosslinking agent or photopolymerization initiator reacts, and, for example, the i-line (wavelength: 365 nm) may be used. No particular limitation is imposed on the amount of exposure so far as adhesion between the flow path wall and the substrate can be ensured and it has desired patterning properties. However, the exposure may be controlled to, for example, 3,500 J/m$^2$ or more and 10,000 J/m$^2$ or less. After the exposure, PEB (post exposure bake may also be conducted. No particular limitation is imposed on the treatment temperature of PEB so far as a curing reaction is stabilized. However, the temperature may be controlled to, for example, 50° C. or more and 100° C. or less. In addition, a treatment time of PEB may be controlled to, for example, 3 minutes or more and 10 minutes or less.

Figure 1C:
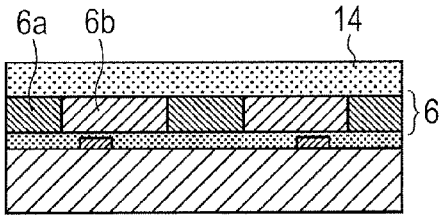

As illustrated in FIG. 1C, an ejection orifice forming layer 14 containing a negative photosensitive resin is then formed on the flow path wall forming layer 6. The same material as the material for the flow path wall forming layer 6 may be used as a material for the ejection orifice forming layer 14. In particular, the photosensitive resin contained in the ejection orifice forming layer 14 and the photosensitive resin contained in the flow path wall forming layer 6 are favorably the same material from the viewpoint of adhesion. The solubility parameter (SP value) of the photosensitive resin contained in the ejection orifice forming layer 14 is favorably 9 or more and 11 or less. Incidentally, the solubility parameter (SP value) is a value calculated according to the following equation (1) by measuring a surface tension.

$$\nu = K(\Delta H - RT)/V^{2/3} \quad (1)$$

wherein ν is surface tension, ΔH is molar heat of vaporization, V is molar volume, T is absolute temperature, and R is gas constant. K is experimentally known to be a constant and regarded as 0.07147. The surface tension is a value measured by an automatic surface tensiometer DY-300 (trade name, manufactured by Kyowa Interface Science Co., Ltd.). The material for the ejection orifice forming layer favorably contains more photopolymerization initiator than the material for the flow path wall forming layer 6, because the sensitivity of the ejection orifice forming layer 14 can be enhanced, and the non-exposed portion 6*b* of the flow path wall forming layer 6 can be allowed not to be cured upon patterning of the ejection orifice which will be described subsequently.

The ejection orifice forming layer 14 is favorably formed by laminating a dry film containing the negative photosensitive resin. As a material for the dry film, the same material as the material for the flow path wall forming layer 6 may favorably be used. However, the material is not limited to this material, and a permanent resist dry film such as, for example, TMMF (trade name, product of TOKYO OHKA KOGYO CO., LTD.) or XP SU-8 3000 (trade name, product of Kayaku Microchem Co., Ltd.) may also be used. In that case, TMMF (trade name, product of TOKYO OHKA KOGYO CO., LTD.) or XP SU-8 3000 (trade name, product of Kayaku Microchem Co., Ltd.) is favorably used as the material for the flow path wall forming layer 6 from the viewpoint of adhesion. A sensitivity difference between photopolymerization initiators themselves may also be utilized to control the sensitivity. For example, a triarylsulfonium salt may be used as a photoacid generator contained in the material for the flow path wall forming layer 6, and an onium salt may also be used as a photoacid generator contained in the material for the ejection orifice forming layer 14. Alternatively, a dry film having a base film composed of PET may also be used to release the base film after the lamination of the dry film. The lamination of the dry film is favorably conducted under reduced pressure. The thickness of the ejection orifice forming layer 14 is favorably 3 μm or more and 40 μm or less, more favorably 3 μm or more and 11 μm or less, particularly favorably 5 μm or more and 10 μm or less from the viewpoint of ejection efficiency. Incidentally, the ejection orifice forming layer may also be formed by, for example, a spin coating method so far as the pattern of the exposed portion 6*a* and non-exposed portion 6*b* formed in the flow path wall forming layer 6 is not destroyed.

Figure 1D:
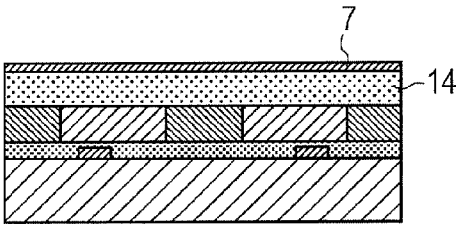

After a step of applying a material for a water-repellent layer on to the ejection orifice forming layer, a solvent contained in the material for the water-repellent layer is then dried to form the water-repellent layer 7 as illustrated in FIG. 1D. The material for the water-repellent layer may contain a material exhibiting water repellency and a solvent. No particular limitation is imposed on the material exhibiting water repellency. However, for example, a hydrolyzable condensate composed of glycidylpropyltriethoxysilane, methyltriethoxysilane, tridecafluoro-1,1,2,2-tetrahydrooctyltriethoxysilane, water and ethanol may be used. No particular limitation is imposed on the solvent. However, for example, tetrahydrofuran, propylene glycol monomethyl ether (PGME) or dioxane may be used. These may be used either singly or any combination thereof.

The absolute value of a difference in solubility parameter (SP value) between the photosensitive resin contained in the ejection orifice forming layer 14 and the solvent contained in the material for the water-repellent layer is favorably less than 3 because the solvent becomes easy to be mixed with the material for the ejection orifice forming layer 14. The absolute value of the difference in solubility parameter (SP value) is more favorably 2 or less, still more favorably 1 or less. Incidentally, the absolute value of the difference in solubility parameter (SP value) is favorably smaller. In particular, it is favorable that the photosensitive resin contained in the ejection orifice forming layer 14 is an epoxy resin, and the solvent contained in the material for the water-repellent layer is tetrahydrofuran. Incidentally, as will be described subsequently, the boiling point of the solvent in the process according to the present invention is not more than a drying temperature upon the formation of the water-repellent layer 7 by the drying. In addition, the boiling point of the solvent is favorably not more than a softening temperature of 70° C. at which the ejection orifice forming layer starts to flow from the viewpoint of the patterning accuracy of the exposed portion 6*a* and non-exposed portion 6*b* of the flow path wall forming layer 6 which have been defined in FIG. 1B. The boiling point of the solvent is more favorably 40° C. or more and 69° C. or less, still more favorably 50° C. or more and 68° C. or less. Incidentally, the boiling point of the solvent is of literature data.

No particular limitation is imposed on a method for applying the material for the water-repellent layer. However, examples thereof include a slit coating method and a spin coating method. The application amount of the material for the water-repellent layer may be controlled to, for example, 3.0E-9 ml or more and 10.0E-9 ml or less per 1 $\mu m^2$. No particular limitation is imposed on the time from the application of the material for the water-repellent layer to the drying. However, the time may be controlled to, for example, 10 seconds or more and 60 seconds or less. The drying temperature upon the drying of the solvent contained in the material for the water-repellent layer applied is not more than the boiling point of the solvent contained in the material for the water-repellent layer. In the present invention, a combination of such a solvent species with such a drying temperature is selected, whereby the photopolymerization initiator contained in the ejection orifice forming layer 14 can be prevented from diffusing into the non-exposed portion 6*b* of the flow path wall forming layer 6. In addition, the drying temperature is favorably not more than a softening temperature, 70° C. at which the ejection orifice forming layer starts to flow from the viewpoint of the patterning accuracy of the exposed portion 6*a* and non-exposed portion 6*b* of the flow path wall forming layer 6 which have been defined in FIG. 1B. The drying temperature is more favorably 40° C. or more and 69° C. or less, still more favorably 50° C. or more and 68° C. or less. No particular limitation is imposed on the drying time. However, the time may be controlled to, for example, 3 minutes or more and 10 minutes or less. The thickness of the water-repellent layer may be controlled to, for example, 0.2 μm or more and 1.0 μm or less.

Figure 1E:
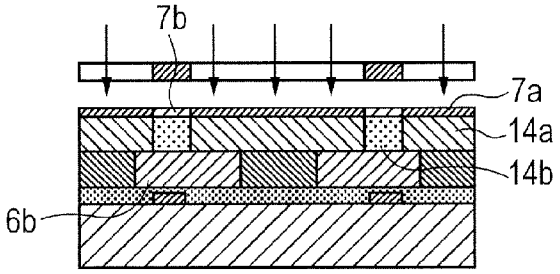

As illustrated in FIG. 1E, another region than portions to be the ejection orifice 13 of the ejection orifice forming layer 14 and the water-repellent layer 7 are then exposed. Exposed portions 14*a* and 7*a* and non-exposed portions 14*b* and 7*b* are thereby optically defined. In this step, the non-exposed portion 6*b* of the flow path wall forming layer 6 does not cause a curing reaction. No particular limitation is imposed on a wavelength upon the exposure so far as it is a wavelength at which the photopolymerization initiator reacts, and, for example, i-line (wavelength: 365 nm) may be used. No particular limitation is imposed on an exposure. However, the exposure may be controlled to, for example, 500 J/$m^2$ or more and 2,000 J/$m^2$ or less. After the exposure, PEB (post exposure bake may also be conducted. No particular limitation is imposed on a treatment temperature of PEB so far as it is a temperature at which the non-exposed portion 6*b* of the flow path wall forming layer 6 and the non-exposed portion 14*b* of the ejection orifice forming layer 14 are not liquefied, and a desired shape can be formed. However, the temperature may be controlled to, for example, 50° C. or more and 100° C. or less. A treatment time of PEB may be controlled to 3 minutes or more and 10 minutes or less.

Figure 1F:
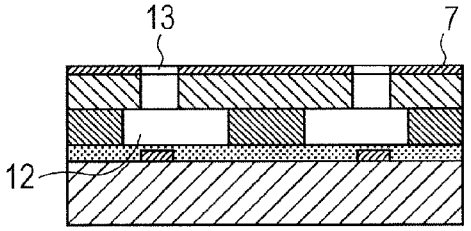

As illustrated in FIG. 1F, respective non-exposed portions of the flow path wall forming layer 6, the ejection orifice forming layer 14 and the water-repellent layer 7 are then dissolved and removed, whereby a flow path 12 and an ejection orifice 13 are formed. This development operation may be conducted either at a time or stepwise. However, the development is favorably conducted at a time. No particular limitation is imposed on a developer used in the development. However, for example, PGMEA may be used.

Figure 1G:
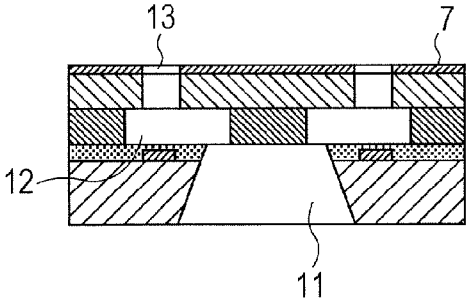

As illustrated in FIG. 1G, a liquid supply port 11 is then formed, and the insulating protective layer 4 on an opening of the liquid supply port 11 is removed. The liquid supply port 11 can be formed by anisotropically etching the substrate 1 with an alkaline etchant such as tetramethylammonium hydroxide (hereinafter referred to as TMAH). The removal of the insulating protective layer 4 on the opening of the liquid supply port 11 can be conducted by, for example, dry etching. The liquid supply port 11 is thereby made to communicate with the flow path 12 and ejection orifice 13.

Through the above-described steps, a substrate for a liquid ejection head, in which a nozzle portion for ejecting a liquid flowing from the liquid supply port 11 through the ejection orifice 13 has been formed, is completed. This substrate is cut and separated into chips by a dicing saw, and an electric wiring for driving the energy-generating element 2 is joined to each chip. Thereafter, a chip tank member for supplying a liquid is joined, thereby completing a liquid ejection head. According to the process of the present invention, the water-repellent layer 7 is compatible with the ejection orifice forming layer 14, and a desired flow path height can be realized with good accuracy to produce a liquid ejection head which is excellent in the ability to refill an ejected liquid and enables high-speed ejection with good yield.

EXAMPLES

Example 1

A process for producing a liquid ejection head according to this embodiment will be described with reference to FIGS. 1A to 1G.

A substrate 1 illustrated in FIG. 1A was first provided. Plural energy-generating elements 2 that are heating resistors are arranged on the surface of the substrate 1. In addition, a wiring (not illustrated) is provided on the surface of the substrate 1. A silicon substrate was used as the substrate 1, and TaSiN was used as the energy-generating elements 2. An insulating protective layer 4 was formed on the substrate 1.

The insulating protective layer 4 was formed by depositing SiO and SiN by plasma CVD. The insulating protective layer 4 has a role of protecting the wiring from an ink and other liquids. A flow path wall forming layer 6 containing a negative photosensitive resin was formed in a thickness of 8 μm on the insulating protective layer 4 by a spin coating method. As a material for the flow path wall forming layer 6, a resist material containing a solid component of an epoxy resin, PGMEA as a solvent and a triarylsulfonium salt, which is a photoacid generator, as a photopolymerization initiator was used.

As illustrated in FIG. 1B, a portion to be a flow path wall of the flow path wall forming layer 6 was then exposed with the i-line (wavelength: 365 nm) by means of FPA-3000i5$^+$ (trade name, manufactured by Canon Inc.), whereby an exposed portion 6*a* to be a flow path wall and a non-exposed portion 6*b* to be a flow path were optically defined. The amount of exposure was controlled to 5,000 J/m$^2$. Thereafter, PEB was conducted for 10 minutes at 60° C.

As illustrated in FIG. 1C, a negative photosensitive dry film having a thickness of 8 μm was then laminated on the flow path wall forming layer 6 under reduced pressure to form an ejection orifice forming layer 14. The photosensitive dry film was composed of the same material as the material for the flow path wall forming layer 6, but contained more photopolymerization initiator than the material for the flow path wall forming layer 6, so that the sensitivity of the ejection orifice forming layer 14 becomes higher. Incidentally, a base film composed of PET was released after the photosensitive dry film was laminated to form the ejection orifice forming layer 14. The solubility parameter (SP value) of the epoxy resin contained in the ejection orifice forming layer 14 was 9.7.

A material for a water-repellent layer 7 was then applied on to the ejection orifice forming layer 14 and dried thereafter to form a water-repellent layer 7 as illustrated in FIG. 1D. As the material for the water-repellent layer 7, a material containing a hydrolyzable condensate composed of glycidylpropyl-triethoxysilane, methyltriethoxysilane, tridecafluoro-1,1,2,2-tetrahydrooctyltriethoxysilane, water and ethanol, as a material exhibiting water repellency, and tetrahydrofuran, as a solvent, was used. The material for the water-repellent layer 7 was applied by a slit coater. The application amount of the material for the water-repellent layer 7 was controlled to 6.0E-9 ml per 1 μm$^2$. After the application, the substrate thus treated was left to stand for 10 seconds, and drying was conducted for 10 minutes at 70° C. Incidentally, the boiling point of tetrahydrofuran is 66° C., and the solubility parameter (SP value) of tetrahydrofuran is 9.1.

As illustrated in FIG. 1E, other regions than portions to be the ejection orifice 13 of the ejection orifice forming layer 14 and the water-repellent layer 7 were then exposed, whereby exposed portions 14*a* and 7*a* and non-exposed portions 14*b* and 7*b* to be the ejection orifice were optically defined. The exposure was conducted with the i-line (wavelength: 365 nm) by means of FPA-3000i5$^+$ (trade name, manufactured by Canon Inc.). The amount of exposure was controlled to 1,000 J/m$^2$. In this step, the non-exposed portion 6*b* of the flow path wall forming layer 6 does not cause a polymerization reaction. Thereafter, PEB was conducted for 4 minutes at 90° C. on a hot plate.

As illustrated in FIG. 1F, the non-exposed portion 6*b* of the flow path wall forming layer 6, the non-exposed portion 14*b* of the ejection orifice forming layer and the non-exposed portion 7*b* of the water-repellent layer 7 were then developed at a time to form a flow path and an ejection orifice 13. PGMEA was used as a developer.

Anisotropic etching was then conducted with an alkaline etchant containing TMAH, whereby a liquid supply port 11 was formed as illustrated in FIG. 1G. Thereafter, the insulating protective layer 4 on the opening of the liquid supply port 11 was removed by dry etching to allow the liquid supply port 11 to communicate with the flow path 12 and ejection orifice 13.

Through the above-described steps, a substrate for a liquid ejection head, in which a nozzle portion for ejecting a liquid flowing from the liquid supply port 11 through the ejection orifice 13 had been formed, was completed. This substrate for the liquid ejection head was cut and separated into chips by a dicing saw. An electric wiring for driving the energy-generating elements 2 was joined to each chip. Thereafter, a chip tank member for supplying a liquid was joined, thereby completing a liquid ejection head.

The above-described liquid ejection head was used to conduct printing. As a result, it was confirmed that the water-repellent layer 7 did not come off by wiping even when the ejection orifice forming layer 14 is thin. In addition, it was confirmed that the ability to refill an ejected liquid was improved, and high-speed ejection could be conducted. The reason for this is considered to be such an effect that since tetrahydrofuran was used as a solvent contained in the water-repellent layer 7, the water-repellent layer 7 was compatible with the ejection orifice forming layer 14, and so the flow path height was hard to become lower than a desired flow path height.

Example 2

A liquid ejection head was produced in the same manner as in Example 1 except that in the step illustrated in FIG. 1D of Example 1, the drying temperature of the solvent contained in the material for the water-repellent layer 7 was changed to 90° C. As a result, the diffusion of the photopolymerization initiator into the non-exposed portion 6*b* of the flow path wall forming layer 6 by permeation of the solvent was not caused, and so the adhesion of the water-repellent layer 7 was able to be ensured. The non-exposed portion 6*b* of the flow path wall forming layer 6 flowed, and the flow path height became lower by about 2 μm than a desired flow path height. However, it was confirmed that the refilling ability is high compared with Comparative Example 1, and high-speed ejection could be conducted. The above-described liquid ejection head was used to conduct printing like Example 1. As a result, it was confirmed that the water-repellent layer 7 did not come off by wiping.

Comparative Example 1

A liquid ejection head was produced in the same manner as in Example 1 except that in the step illustrated in FIG. 1D of Example 1, PGMEA was used as the solvent contained in the material for the water-repellent layer 7. The boiling point of PGMEA is 146° C. and higher than the drying temperature (70° C.), and the solubility parameter (SP value) of PGMEA is 8.7. As a result, the water-repellent layer 7 was compatible with the ejection orifice forming layer 14, and the adhesion of the water-repellent layer 7 was able to be ensured. However, the flow path height became lower by about 3 μm than a desired flow path height. The above-described liquid ejection head was used to conduct printing under the same conditions as in Example 1. As a result, the water-repellent layer 7 did not come off by wiping. It was however confirmed that the refilling ability was lowered because the flow path height became lower than the desired flow path height, and printing failure was caused due to ejection failure.

Comparative Example 2

A liquid ejection head was produced in the same manner as in Example 1 except that in the step illustrated in FIG. 1D of Example 1, ethanol was used as the solvent contained in the material for the water-repellent layer 7. The boiling point of ethanol is 78° C. and higher than the drying temperature (70° C.), and the solubility parameter (SP value) of ethanol is 12.7, and the absolute value of a difference from the SP value (9.7) of the epoxy resin contained in the ejection orifice forming layer 14 is 3 or more. As a result, the water-repellent layer 7 was not compatible with the ejection orifice forming layer 14. The above-described liquid ejection head was used to conduct printing under the same conditions as in Example 1. As a result, It was confirmed that the water-repellent layer 7 came off by physical external force such as wiping because the water-repellent layer was not compatible with the ejection orifice forming layer 14.

According to the present invention, there can be provided a liquid ejection head having a flow path height with high accuracy for a desired flow path height.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-208131, filed Sep. 21, 2012, which is hereby incorporated by reference herein in its entirety.

What is claimed is:

1. A process for producing a liquid ejection head, comprising the steps of:

providing a substrate provided with an energy-generating element for generating energy for ejecting a liquid and a wiring;

forming a flow path wall forming layer containing a negative photosensitive resin on the substrate;

exposing a portion to be a flow path wall of the flow path wall forming layer;

forming an ejection orifice forming layer containing a negative photosensitive resin on the flow path wall forming layer;

applying a material for a water-repellent layer on to the ejection orifice forming layer;

drying a solvent contained in the applied material for the water-repellent layer to form the water-repellent layer;

exposing another region than a portion to be an ejection orifice of the ejection orifice forming layer and the water-repellent layer; and dissolving and removing respective non-exposed portions of the flow path wall forming layer, the ejection orifice forming layer and the water-repellent layer, wherein a boiling point of the solvent contained in the material for the water-repellent layer is not more than a drying temperature in the drying step, and wherein an absolute value of a difference in solubility parameter (SP value) between the negative photosensitive resin contained in the ejection orifice forming layer and the solvent contained in the material for the water-repellent layer is less than 3.

2. The process according to claim 1, wherein a thickness of the ejection orifice forming layer is 5 μm to 10 μm.

3. The process according to claim 1, wherein the drying temperature in the drying step is 40° C. to 70° C.

4. The process according to claim 1, wherein the negative photosensitive resin contained in the ejection orifice forming layer is an epoxy resin, and the solvent contained in the material for the water-repellent layer is tetrahydrofuran.

5. The process according to claim 1, wherein the ejection orifice forming layer is formed by laminating a dry film containing the negative photosensitive resin.

6. The process according to claim 1, wherein the negative photosensitive resin contained in the flow path wall forming layer and the negative photosensitive resin contained in the ejection orifice forming layer are the same resin.

7. A process for producing a liquid ejection head, comprising the steps of:

providing a substrate provided with an energy-generating element for generating energy for ejecting a liquid and a wiring;

forming a flow path wall forming layer containing a negative photosensitive resin on the substrate;

exposing a portion to be a flow path wall of the flow path wall forming layer;

forming an ejection orifice forming layer containing a negative photosensitive resin on the flow path wall forming layer;

applying a material for a water-repellent layer on to the ejection orifice forming layer;

drying a solvent contained in the applied material for the water-repellent layer to form the water-repellent layer;

exposing another region than a portion to be an ejection orifice of the ejection orifice forming layer and the water-repellent layer; and dissolving and removing respective non-exposed portions of the flow path wall forming layer, the ejection orifice forming layer and the water-repellent layer, wherein a boiling point of the solvent contained in the material for the water-repellent layer is not more than a drying temperature in the drying step, and wherein the drying temperature in the drying step is 40° C. to 70° C.

8. The process according to claim 7, wherein a thickness of the ejection orifice forming layer is 5 μm to 10 μm.

9. The process according to claim 7, wherein the negative photosensitive resin contained in the ejection orifice forming layer is an epoxy resin, and the solvent contained in the material for the water-repellent layer is tetrahydrofuran.

10. The process according to claim 7, wherein the ejection orifice forming layer is formed by laminating a dry film containing the negative photosensitive resin.

11. The process according to claim 7, wherein the negative photosensitive resin contained in the flow path wall forming layer and the negative photosensitive resin contained in the ejection orifice forming layer are the same resin.

12. A process for producing a liquid ejection head, comprising the steps of:

providing a substrate provided with an energy-generating element for generating energy for ejecting a liquid and a wiring;

forming a flow path wall forming layer containing a negative photosensitive resin on the substrate;

exposing a portion to be a flow path wall of the flow path wall forming layer;

forming an ejection orifice forming layer containing a negative photosensitive resin on the flow path wall forming layer;

applying a material for a water-repellent layer on to the ejection orifice forming layer;

drying a solvent contained in the applied material for the water-repellent layer to form the water-repellent layer;

exposing another region than a portion to be an ejection orifice of the ejection orifice forming layer and the water-repellent layer; and dissolving and removing respective non-exposed portions of the flow path wall forming layer, the ejection orifice forming layer and the water-repellent layer, wherein a boiling point of the solvent contained in the material for the water-repellent layer is not more than a drying temperature in the drying step, and wherein the negative photosensitive resin contained in the ejection orifice forming layer is an epoxy resin, and the solvent contained in the material for the water-repellent layer is tetrahydrofuran.

13. The process according to claim 12, wherein a thickness of the ejection orifice forming layer is 5 μm to 10 μm.

14. The process according to claim 12, wherein the ejection orifice forming layer is formed by laminating a dry film containing the negative photosensitive resin.

15. The process according to claim 12, wherein the negative photosensitive resin contained in the flow path wall forming layer and the negative photosensitive resin contained in the ejection orifice forming layer are the same resin.

* * * * *